United States Patent [19]

Dunlap et al.

[11] 3,936,048

[45] Feb. 3, 1976

[54] LUNG EXERCISE DEVICE

[75] Inventors: Glenn H. Dunlap, Maumee; James B. Foote, Sylvania, both of Ohio

[73] Assignee: Owens-Illinois, Inc., Toledo, Ohio

[22] Filed: Jan. 8, 1975

[21] Appl. No.: 539,292

[52] U.S. Cl. ..... 272/57 F; 128/2.08

[51] Int. Cl.[2] ..... A63B 23/00

[58] Field of Search..... 272/57 F; 128/2.08; 46/41, 46/44, 91

[56] References Cited

UNITED STATES PATENTS

| | | | |
|---|---|---|---|
| 3,811,671 | 5/1974 | Turnbull | 272/57 F |

FOREIGN PATENTS OR APPLICATIONS

| | | | |
|---|---|---|---|
| 757,395 | 1933 | France | 272/57 F |
| 859,316 | 1940 | France | 272/57 F |

*Primary Examiner*—Richard J. Apley
*Assistant Examiner*—Joseph R. Taylor
*Attorney, Agent, or Firm*—Howard G. Bruss, Jr.; E. J. Holler

[57] ABSTRACT

An improved "blow bottle" for forced expiration exercise wherein liquid is blown from a first compartment to a second compartment and then automatically returned to the first compartment by a specially designed siphon assembly.

5 Claims, 8 Drawing Figures

LUNG EXERCISE DEVICE

This invention relates to a device for respiratory exercise. More particularly, the invention pertains to an efficient and practical device wherein liquid is blown between interconnecting chambers by forced expiration to achieve respiratory stimulation.

In the treatment of certain pulmonary conditions it is often desirable for the patient to exercise his lungs by forced expiration against a known or controlled resistance to achieve respiratory stimulation and rehabilitation. Such stimulation is believed to develop and condition the muscles and tissues associated with the breathing process.

In the past, several types of devices, which are generally known in the art as "blow bottles", have been proposed for this purpose. For instance U.S. Pat. No. 3,811,671 discloses a side-by-side blow bottle arrangement where the tube connecting adjoining chambers has a restriction therein to prevent siphoning from one compartment to the other during the exercise process.

French Pat. Nos. 859,316 and 757,395 apparently disclose blow bottles wherein liquid is blown back and forth between interconnecting chambers through a complex network of interconnecting tubes.

British Pat. No. 685,815 shows a blow bottle wherein the patient blows water from a lower chamber to an upper chamber through a tube. The water immediately drains back to the lower chamber when the pressure is released from the blowing tube as occurs between breaths. This is inconvenient and causes a disruption in the exercise process.

U.S. Pat. No. 714,141 discloses a blow bottle wherein water is blown or sucked between adjoining side-by-side chambers through an inverted U-tube. This blow bottle is not vented during the exercise and the air confined in the chambers provides controlled resistance for the exercise.

The present invention represents an improvement over these early devices in providing a compact and efficient blow bottle which is easily used by the patient to blow liquid from a lower chamber to an upper chamber. When a predetermined volume of liquid has been transferred to the upper chamber, a siphoning mechanism is automatically actuated to siphon the liquid from the upper chamber to the lower chamber. Blowing is discontinued until the liquid is returned to the lower chamber. This sequence of operation is schematically shown in FIGS. 4*a* through 4*d*. The exercise procedure can then be repeated without adjusting the device, rearranging the tubing or other inconvenient preparatory procedures on the part of the patient. The device of invention is also adapted for a program of timed exercises in that it requires the transfer of a predetermined volume of liquid to activate the siphon and the time to accomplish the result can be easily measured.

The present invention will be further illustrated in the drawings wherein.

Figure 1:
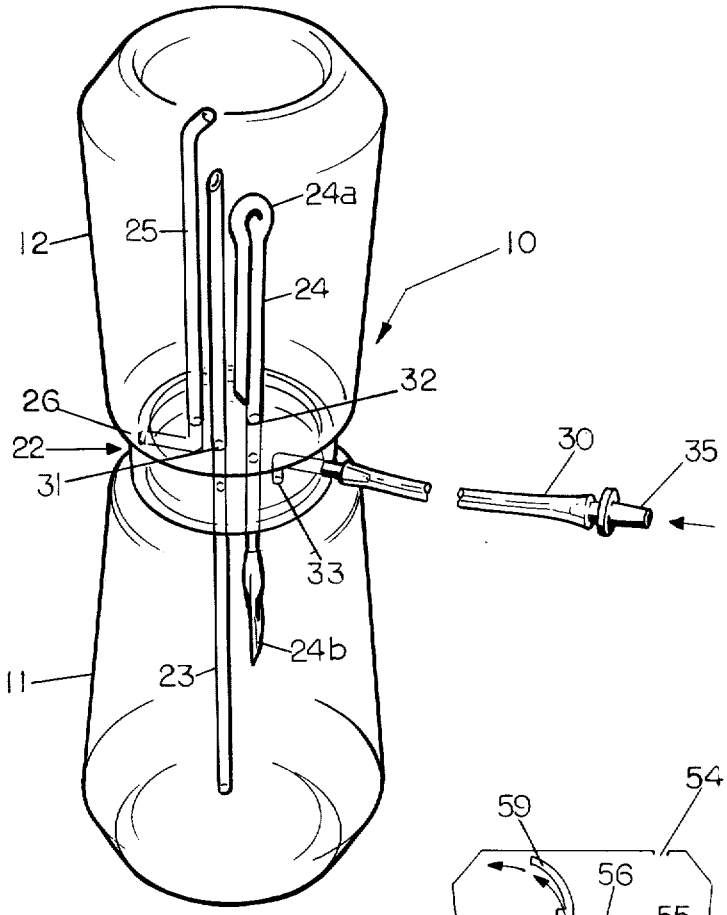
FIG. 1 is a perspective view of a blow bottle of invention.
Figure 2:
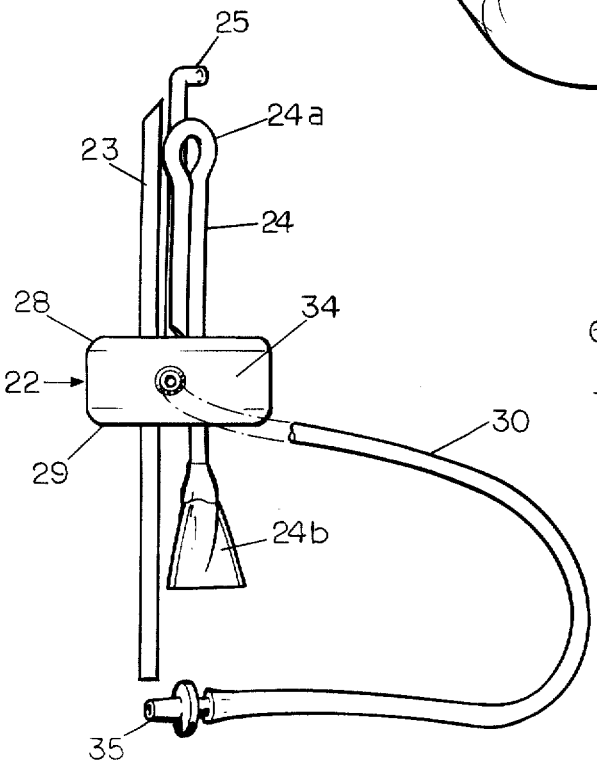
FIG. 2 is a view of the septum assembly of the blow bottle of FIG. 1.
Figure 5:
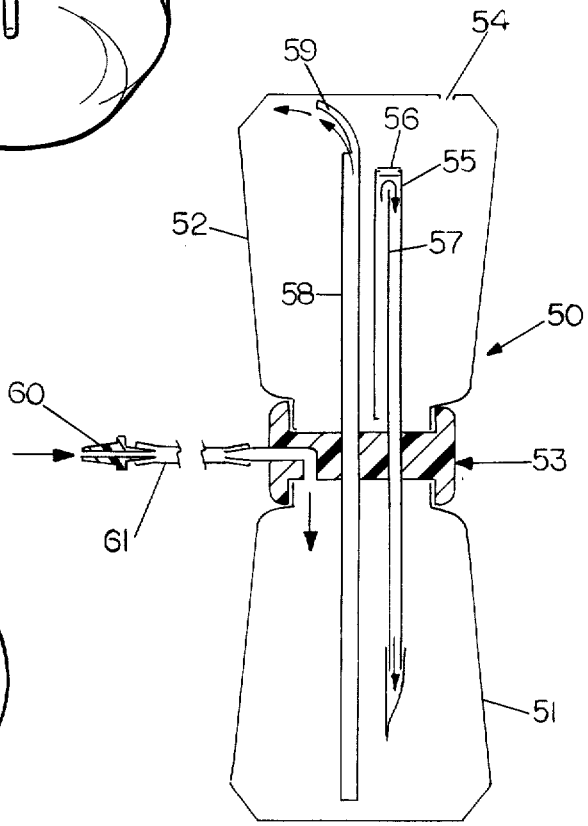

FIGS. 4*a* through 4*d* are a series of schematic representations illustrating the sequence of operation of the device of FIG. 1, and FIG. 5 is a view of another embodiment of the present invention having a modified siphon arrangement and vent location.

In attaining the objectives of this invention, one feature resides in a blow bottle comprising a chamber partitioned by a septum into an upper compartment and a lower compartment, the upper compartment being vented to the ambient and the lower compartment being interconnected to an external blow tube. The compartments communicate with each other by means of a liquid transfer tube passing through the septum for transferring blown liquid from the lower compartment to the upper compartment. The transfer tube extends down to near the bottom of the lower compartment and up to near the top of the upper compartment. The compartments also communicate with each other by means of a siphon tube passing through the septum. The siphon tube has an inverted "U-bend" therein which is positioned in the upper compartment. The height of the inverted U-bend in the upper compartment is less than the height of the liquid transfer tube to permit the transfer of a sufficient head of liquid to prime the siphon. The siphon tube also has one-way check valve positioned therein to restrict fluid flow from the lower chamber to the upper chamber.

Figure 3:
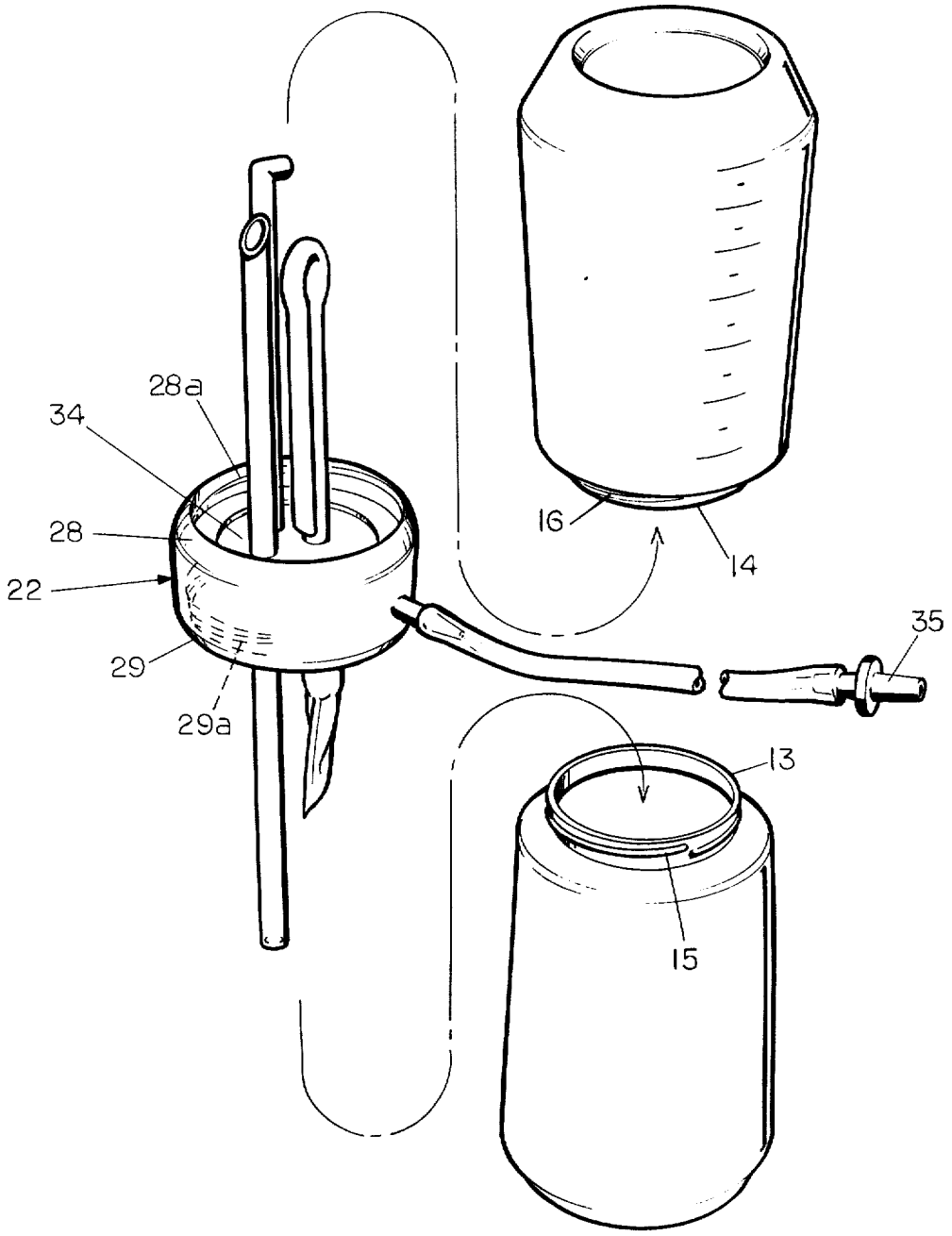
FIG. 3 is an exploded view of the device of FIG. 1.

Referring now to FIG. 1 through 4, reference numeral 10 generally indicates a blow bottle of invention comprising a lower compartment or container 11 and an upper compartment or container 12 both of which are in the form of self-supporting open-mouthed plastic containers of like configuration and volume capacity. It is, of course, understood that the containers can be of different sizes and shapes if this is desirable for certain applications. As best seen in FIG. 3, the mouths 13 and 14 of containers 11 and 12 are provided with external screw threads 15 and 16. The capacity of the containers can be varied depending on the particular application, although a volume capacity for each container of about ½ liter to about 1 liter are practical for most applications. Containers 11 and 12 are preferably transparent or translucent to facilitate observation. Mouths 15 and 16 of containers 11 and 12 are adapted for liquid sealing engagement with septum assembly 22.

Septum assembly 22 comprises a rigid disc-shaped central partition 34 having apertures 26, 31, 32, and 33 passing therethrough. The upper and lower peripheries of partition 34 are provided with rims 28 and 29 which are internally provided with screw threads **28*a* and 29*a* which are adapted for registry with screw threads 15 and 16**.

Positioned in and passing through aperture 31 in partition 34 is liquid transfer tube 23 which extends in both directions so as to come within about 1 or 2 inches from the top of upper container 12 and bottom of lower container 11. Positioned in and passing through aperture 32 in partition 34 is siphon tube 24 which has an inverted "U-bend" **24*a*. The inverted U-bend 24*a* of siphon tube 24 generally extends in an upward direction into upper container 12, but a lesser distance (i.e. a lower height) than liquid transfer tube 23 so that the inverted U-bend 24*a* will be filled with liquid and thereby "primed" during the exercise process. A height difference of about ¼ inch to ½ inch between liquid transfer tube 25 and the inverted U-bend 24*a*** is adequate for most applications.

Siphon tube 24 also extends below partition 34 into lower container 11, and is provided with a check valve **24*b* in the form of a flexible flapper of rubber or like material. Other types of check valves such as a swing check valve can also be employed. Valve 24***b* is flattened on the end to restrict fluid flow to a downwardly direction through the valve while providing a seal against liquid or other fluid flow in an upwardly direction. The distance that siphon tube 24 extends into container 11 does not affect operation.

Positioned in and passing through aperture 26 in partition 34 is vent tube 25 which communicates with the ambient. Vent tube 25 extends upwardly into container 12 to the height above liquid transfer tube 23 so that vent tube 25 will not be covered with liquid at any stage of the exercise process.

Positioned in and passing through aperture 33 in partition 34 is blow tube 30 equipped with mouth piece 35 through which the patient blows to pressurize lower container 11 and begin the exercise process.

Figure 4B:
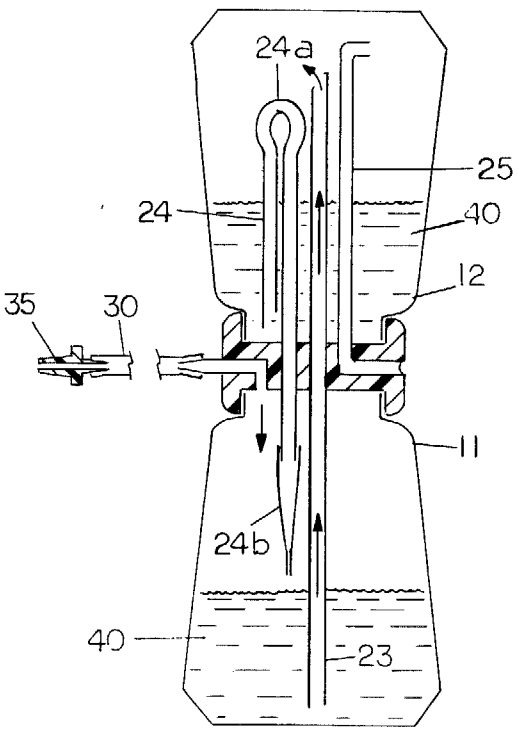
Figure 4A:
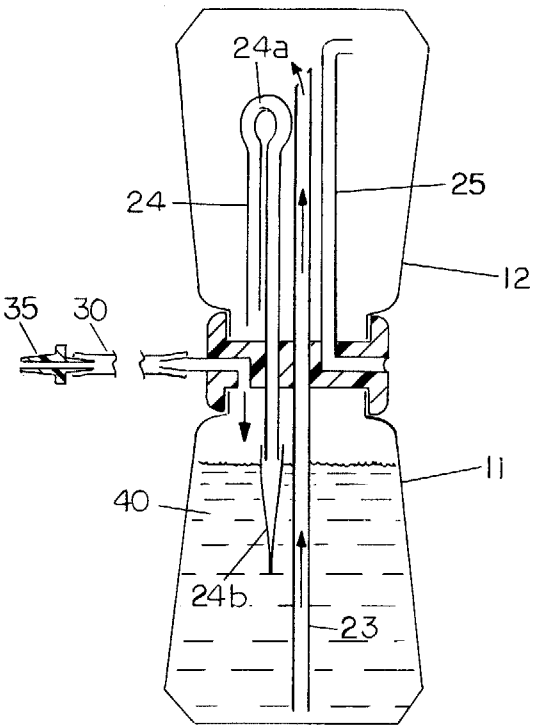
Figure 4D:
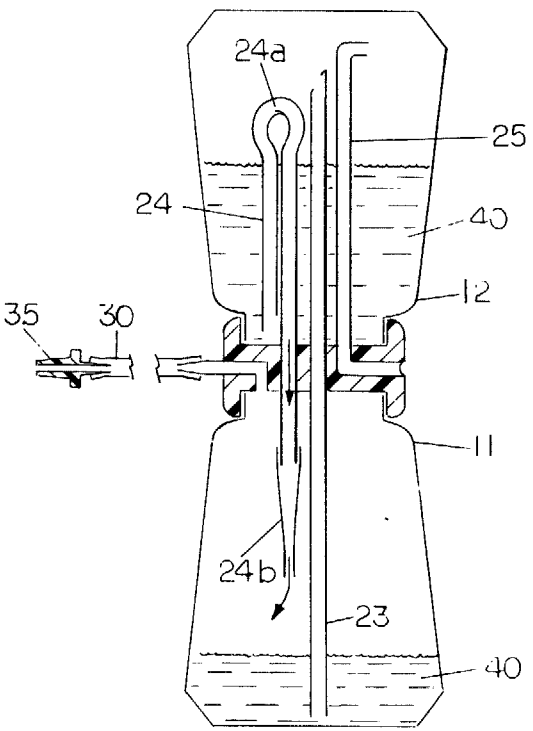
Figure 4C:
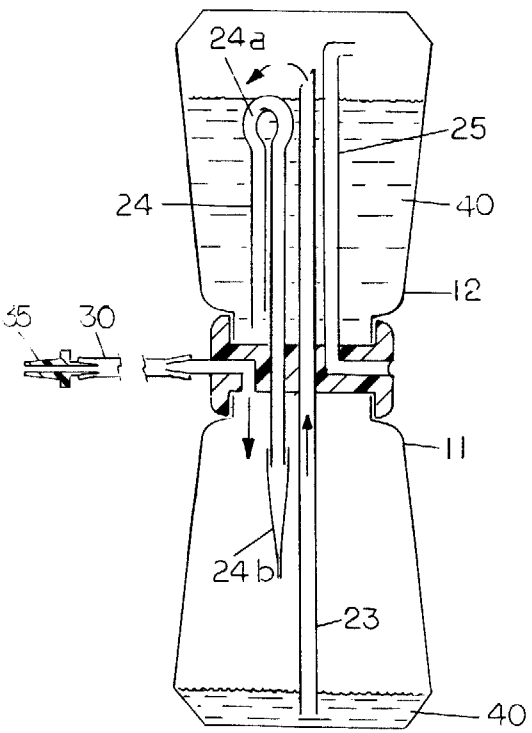

The sequence of operation can best be seen from FIG. 4*a*, *b*, *c*, and *d*. In FIG. 4*a* lower container 11 is filled with a convenient liquid such as water 40 which can be colored for ease of viewing. The patient blows into blow tube 30 which causes an increase in pressure in lower container 11 above water 40. Water 40 then begins to rise up the liquid transfer tube 23 as shown by the arrows. This liquid transfer continues until it fills the inverted U-bend 24*a* in siphon tube 24 as shown in FIG. 4*c*. During this blowing process, the check valve 24*b* prevents liquid or air flow up through siphon tube 24. As water 40 fills upper container 12, the air displaced thereby is vented to the ambient through vent tube 25. The water 40 then automatically siphons through siphon tube 24 to lower container 11 as shown in FIG. 4*d* until the siphon action "breaks" due to a lower water level in container 12. This completes one unit of exercise.

In the sequence of operation shown in FIGS. 4*a* through 4*d* it is readily seen that the water cannot rise in upper chamber 12 above the level of the inverted U-bend because the siphoning action is automatically initiated. The short distance (e.g. about ¼ inch to ½ inch) that the liquid transfer tube 23 extends above the height of the inverted U-bend 24*a* assures the complete filling of the siphon tube. Vent tube 25 is positioned above the height of the liquid transfer tube 23 a slight distance (e.g. about ¼ inch) so that water cannot enter vent tube 25.

FIG. 5 shows another embodiment of a blow bottle 50 comprising lower container 51 and upper container 52 engaged to septum assembly 53 as described above except that upper container 52 is vented directly to the ambient through vent aperture 54 in container 52 rather than through a vent tube. The inverted U-bend

56 in siphon tube 55 is defined by the top of tube 55 and a weir 57 positioned in siphon tube 55. Liquid transfer tube 58 is equipped with a deflection shield 59 to direct the liquid away from vent aperture 54. Mouth piece 60 on blow tube 61 can be adapted to fit snugly into vent aperture 54 for the purpose of storage when not in use.

The device can be fabrication of conventional materials such as glass or plastic although plastic is preferred because of ease of formation of intricate parts. It is apparent that different details of construction and assembly of the containers and septum can be employed within the scope of the present invention depending on the economics of manufacture.

Having thus described the invention, what is claimed is:

1. In a device for forced expiration exercise wherein liquid is blown between interconnecting compartments to achieve respiratory stimulation, the improvement comprising:

a chamber partitioned by a septum into an upper compartment and a lower compartment said upper compartment being vented to the ambient and said lower compartment being interconnected to an external blow tube, said compartments communicating with each other by means of a liquid transfer tube passing through said septum for transferring blown liquid from said lower compartment to said upper compartment, said transfer tube extending to near the bottom of lower compartment and to near the top of said upper compartment; and a siphon tube for siphoning liquid form said upper compartment to said lower compartment, passing through said septum, said siphon tube having an inverted U-bend therein which is positioned in said upper compartment and extends into said upper compartment a lesser distance than said liquid transfer tube, said siphon tube having a check valve therein to restrict fluid flow from the lower chamber to the upper chamber.

2. The device of claim 1 wherein said check valve is a flexible flapper valve.

3. The device of claim 1 wherein said upper compartment is vented through a vent tube communicating with the ambient through said septum.

4. The device of claim 1 wherein said upper compartment is vented to the ambient through a vent aperture through the top of said compartment.

5. The device of claim 1 wherein said upper and lower compartments are in the form of open-mouthed containers of like configuration and capacity.

* * * * *